US011903479B2

(12) United States Patent
Chen et al.

(10) Patent No.: US 11,903,479 B2
(45) Date of Patent: Feb. 20, 2024

(54) HAMMOCK

(71) Applicant: Libin Chen, Changzhou (CN)

(72) Inventors: Libin Chen, Changzhou (CN); Qinglei Kong, Changzhou (CN)

(73) Assignee: Libin Chen, Changzhou (CN)

( * ) Notice: Subject to any disclaimer, the term of this patent is extended or adjusted under 35 U.S.C. 154(b) by 59 days.

(21) Appl. No.: 17/566,520

(22) Filed: Dec. 30, 2021

(65) Prior Publication Data

US 2022/0202172 A1 Jun. 30, 2022

(30) Foreign Application Priority Data

Dec. 30, 2020 (CN) ..... 202023280942.X
May 25, 2021 (CN) ..... 202121141511.7

(51) Int. Cl.
*A45F 3/24* (2006.01)

(52) U.S. Cl.
CPC ..... *A45F 3/24* (2013.01)

(58) Field of Classification Search
CPC ..... A45F 3/22; A45F 3/24; A45F 3/26; A45F 4/08
See application file for complete search history.

(56) References Cited

U.S. PATENT DOCUMENTS 4,925,138 A * 5/1990 Rawlins ..... A45F 3/24 5/127
6,467,109 B1 * 10/2002 Wu ..... A45F 3/24 5/120
7,926,129 B2 * 4/2011 Reeb ..... A45F 3/24 5/127
7,996,935 B1 * 8/2011 Chen ..... A45F 3/24 5/120
10,441,060 B1 * 10/2019 Pinholster, Jr. ..... A45F 3/24
11,191,362 B1 * 12/2021 Brinkley ..... A45F 3/24
11,259,638 B2 * 3/2022 Chen ..... A47C 4/286
11,388,977 B2 * 7/2022 Gibson ..... A45F 3/24
11,497,315 B2 * 11/2022 Chen ..... A47C 1/03205
2006/0282948 A1 * 12/2006 Deng ..... A45F 3/24 5/127
2007/0079442 A1 * 4/2007 Stoll ..... A45F 3/24 5/120
2007/0113337 A1 * 5/2007 Hug ..... A45F 3/22 5/120
2010/0287700 A1 * 11/2010 Reeb ..... A45F 3/24 5/120

(Continued)

*Primary Examiner* — Justin C Mikowski
*Assistant Examiner* — George Sun
(74) *Attorney, Agent, or Firm* — Bayramoglu Law Offices LLC

(57) ABSTRACT

A hammock includes a hammock body and a hammock support, where the hammock body includes a fabric and a hammock body frame; the fabric is made of a flexible material and is fixedly connected to the hammock body frame; the hammock body is connected to the hammock support through hanging assemblies; and the hammock body frame is longitudinally foldaway from an unfolded state to a half-folded state and transversely foldaway from the half-folded state to a fully folded state. The hammock body is foldaway, and the fabric is large, comfortable and portable. When the hammock body is unfolded, the hammock is stable and will not collapse. When the hammock body is fully folded, the structure is compact and not easy to loosen.

17 Claims, 14 Drawing Sheets

(56) References Cited

U.S. PATENT DOCUMENTS

| | | | | |
|---|---|---|---|---|
| 2011/0231992 | A1* | 9/2011 | Bernat | A45F 3/24 5/127 |
| 2014/0338123 | A1* | 11/2014 | Weindel | A45F 3/22 5/123 |
| 2016/0113402 | A1* | 4/2016 | Lee | A47C 4/42 297/16.2 |
| 2019/0048613 | A1* | 2/2019 | Bierwolf | E04H 15/40 |
| 2019/0343267 | A1* | 11/2019 | Drew | F16B 7/048 |
| 2021/0219707 | A1* | 7/2021 | Sun | A45F 3/24 |

* cited by examiner

HAMMOCK

CROSS REFERENCE TO THE RELATED APPLICATIONS

This application is based upon and claims priority to Chinese Patent Application No. 202023280942.X, filed on Dec. 30, 2020, and Chinese Patent Application No. 202121141511.7, filed on May 25, 2021, the entire contents of which are incorporated herein by reference.

TECHNICAL FIELD

The present application relates to the field of outdoor products, and in particular to a hammock.

BACKGROUND

People often carry chairs or hammocks for rest during outdoor activities. The existing hammocks have a simple structure. The fabric of the hammock is tied to trees through a simple fastening device, which is inconvenient to install and use. Further, the user has to curl up when lying on the hammock, such a sleeping posture makes the user uncomfortable. There are also some other hammocks where the user can lie, but they are large and not portable.

SUMMARY

In order to solve the above problems existing in the prior art, the present application provides a hammock.

In order to solve the technical problems, the present application adopts the following technical solution:

A hammock includes a hammock body and a hammock support, where the hammock body includes a fabric and a hammock body frame; the fabric is made of a flexible material and is fixedly connected to the hammock body frame; the hammock body is connected to the hammock support through hanging assemblies; and the hammock body frame is longitudinally foldaway from an unfolded state to a half-folded state and transversely foldaway from the half-folded state to a fully folded state.

In some solutions, the hammock body frame may include a first rear support rod, a second rear support rod, a first front support rod and a second front support rod; a rear end of the first rear support rod may be hinged to a rear end of the second rear support rod; a front end of the first front support rod may be hinged to a front end of the second front support rod; a front end of the first rear support rod and a rear end of the first front support rod may be pivotally connected through a first pivot shaft; a front end of the second rear support rod and a rear end of the second front support rod may be pivotally connected through a second pivot shaft; and when the hammock body frame is in the half-folded state, the fully folded state or a state there-between, the first pivot shaft and the second pivot shaft may be coaxial.

Preferably, the hammock body frame further may include a rear connector and a front connector; the rear end of the first rear support rod and the rear end of the second rear support rod may be pivotally connected to the rear connector through a third pivot shaft and a fourth pivot shaft respectively; the front end of the first front support rod and the front end of the second front support rod may be pivotally connected to the front connector through a fifth pivot shaft and a sixth pivot shaft respectively; and when the hammock body frame is in the unfolded state, the half-folded state or a state there-between, the third pivot shaft and the fifth pivot shaft may be coaxial, and the fourth pivot shaft and the sixth pivot shaft may be coaxial.

Preferably, when the hammock body frame is in the unfolded state, a limiting portion of the rear connector prevents the first rear support rod and the second rear support rod from being unfolded relatively, and a limiting portion of the front connector prevents the first front support rod and the second front support rod from being unfolded relatively.

Preferably, the hammock body frame may include a first middle connector and a second middle connector; the front end of the first rear support rod and the rear end of the first front support rod may be pivotally connected to the first middle connector through the first pivot shaft; the front end of the second rear support rod and the rear end of the second front support rod may be pivotally connected to the second middle connector through the second pivot shaft; and when the hammock body frame is in the unfolded state, the half-folded state or a state there-between, a limiting portion of the first middle connector prevents the first rear support rod and the first front support rod from being unfolded relatively, and a limiting portion of the second middle connector prevents the second rear support rod and the second front support rod from being unfolded relatively.

Preferably, the hammock support may include two standing posts; two hanging assemblies may be respectively located on two sides of the hammock body frame and respectively correspond to the two standing posts; the hanging assemblies each may include hanging straps and a first connector; the first connector may be connected between two ends of the hanging straps; the first connector may be connected to an upper end of a corresponding standing post; and two ends of the hanging straps may be connected to the hammock body frame or the fabric.

Preferably, the hammock support further may include a transverse connection assembly; and the two standing posts may be connected through the transverse connection assembly and may be spaced apart.

Preferably, the hammock further may include a pull strap made of a flexible material; and a front end of the pull strap may be connected to a front end of the fabric or a front end of the hammock body frame, and a rear end of the pull strap may be connected to the transverse connection assembly.

Preferably, the fabric may include a central area and a peripheral area; the peripheral area surrounds the central area and bulges with respect to the central area; the central area may include multiple united pieces made of a flexible material; adjacent united pieces may be spliced together; and an edge of each of the united pieces at a splicing joint has a length greater than a straight-line distance between two ends of the edge.

In some solutions, the hammock support may include four standing posts; two pairs of hanging assemblies may be respectively located on two sides of the hammock body frame and respectively correspond to the four standing posts; the hanging assemblies each may include a hanging strap and a first connector; the first connector may be connected to one end of the hanging strap, and the first connector may be connected to an upper end of a corresponding standing post; and the other end of the hanging strap may be connected to the hammock body frame or the fabric;

the hammock further may include a pull strap made of a flexible material; and a front end of the pull strap may be connected to a front end of the fabric or a front end of the hammock body frame, and a rear end of the pull strap may be connected to the transverse connection assembly; and the fabric may include a central area and a peripheral area; the peripheral area surrounds the central area and bulges with respect to the central area; the central area may include multiple united pieces made of a flexible material; adjacent united pieces may be spliced together; and an edge of each of the united pieces at a splicing joint has a length greater than a straight-line distance between two ends of the edge.

In some solutions, the hammock support may include two mirror-symmetric first supporting mechanisms; and the first supporting mechanisms each include:

a first intersecting post and a second intersecting post intersecting and hinged at an intersection;

a first slanting post, where one end of the first slanting post may be hinged to the first intersecting post, and the other end of the first slanting post may be hinged to a first sliding member slidably fit with the second intersecting post; and a second slanting post, where one end of the second slanting post may be hinged to the second intersecting post, and the other end of the second slanting post may be hinged to a second sliding member slidably fit with the first intersecting post;

the hammock support further may include two mirror-symmetric second supporting mechanisms; and the second supporting mechanisms may be connected between the two first supporting mechanisms, such that the two first supporting mechanisms may be able to move toward and away from each other; and a left side of the hammock body may be connected to two first intersecting posts through two hanging assemblies, and a right side of the hammock body may be connected to two second intersecting posts through two hanging assemblies.

Preferably, the hammock body frame may include a first rear support rod, a second rear support rod, a first front support rod and a second front support rod; a rear end of the first rear support rod may be hinged to a rear end of the second rear support rod; a front end of the first front support rod may be hinged to a front end of the second front support rod; a front end of the first rear support rod and a rear end of the first front support rod may be pivotally connected through a first pivot shaft; a front end of the second rear support rod and a rear end of the second front support rod may be pivotally connected through a second pivot shaft; and when the hammock body frame is in the half-folded state, the fully folded state or a state there-between, the first pivot shaft and the second pivot shaft may be coaxial.

Preferably, the hammock body frame further may include a rear connector and a front connector; the rear end of the first rear support rod and the rear end of the second rear support rod may be pivotally connected to the rear connector through a third pivot shaft and a fourth pivot shaft respectively; the front end of the first front support rod and the front end of the second front support rod may be pivotally connected to the front connector through a fifth pivot shaft and a sixth pivot shaft respectively; and when the hammock body frame is in the unfolded state, the half-folded state or a state there-between, the third pivot shaft and the fifth pivot shaft may be coaxial, and the fourth pivot shaft and the sixth pivot shaft may be coaxial.

Preferably, when the hammock body frame is in the unfolded state, a limiting portion of the rear connector prevents the first rear support rod and the second rear support rod from being unfolded relatively, and a limiting portion of the front connector prevents the first front support rod and the second front support rod from being unfolded relatively.

Preferably, the hammock body frame may include a first middle connector and a second middle connector; the front end of the first rear support rod and the rear end of the first front support rod may be pivotally connected to the first middle connector through the first pivot shaft; the front end of the second rear support rod and the rear end of the second front support rod may be pivotally connected to the second middle connector through the second pivot shaft; and when the hammock body frame is in the unfolded state, the half-folded state or a state there-between, a limiting portion of the first middle connector prevents the first rear support rod and the first front support rod from being unfolded relatively, and a limiting portion of the second middle connector prevents the second rear support rod and the second front support rod from being unfolded relatively.

Preferably, the hanging assemblies each may include a hanging strap and a first connector; one end of the hanging strap may be connected to the hammock body, and the other end of the hanging strap may be connected to the first connector; first connectors on the left side of the hammock body may be respectively connected to upper ends of the two first intersecting posts; and first connectors on the right side of the hammock body may be respectively connected to upper ends of the two second intersecting posts.

Preferably, the second supporting mechanisms each may include a third intersecting post and a fourth intersecting post interesting and hinged at an intersection;

upper ends of two third intersecting posts may be respectively hinged to two sixth connectors; the two sixth connectors may be respectively hinged to the first intersecting post and the second intersecting post on a front side; lower ends of the two third intersecting posts may be respectively hinged to two first supporting bases; and a lower end of the first intersecting post and a lower end of the second intersecting post on a rear side may be respectively hinged to the two first supporting bases; and upper ends of two fourth intersecting posts may be respectively hinged to two fifth connectors; the two fifth connectors may be respectively hinged to the first intersecting post and the second intersecting post on the rear side; lower ends of the two fourth intersecting posts may be respectively hinged to two second supporting bases; and a lower end of the first intersecting post and a lower end of the second intersecting post on the front side may be respectively hinged to the two second supporting bases.

Preferably, the fabric may include a central area and a peripheral area; the peripheral area surrounds the central area and bulges with respect to the central area; the central area may include multiple united pieces made of a flexible material; adjacent united pieces may be spliced together; and an edge of each of the united pieces at a splicing joint has a length greater than a straight-line distance between two ends of the edge.

The present application has the following beneficial effects. The hammock body is foldaway, and the fabric is large, comfortable and portable. When the hammock body is unfolded, the hammock is stable and will not collapse. When the hammock body is fully folded, the structure is compact and not easy to loosen.

BRIEF DESCRIPTION OF THE DRAWINGS

The present application is described in further detail below with reference to the drawings and embodiments.

Figure 1:
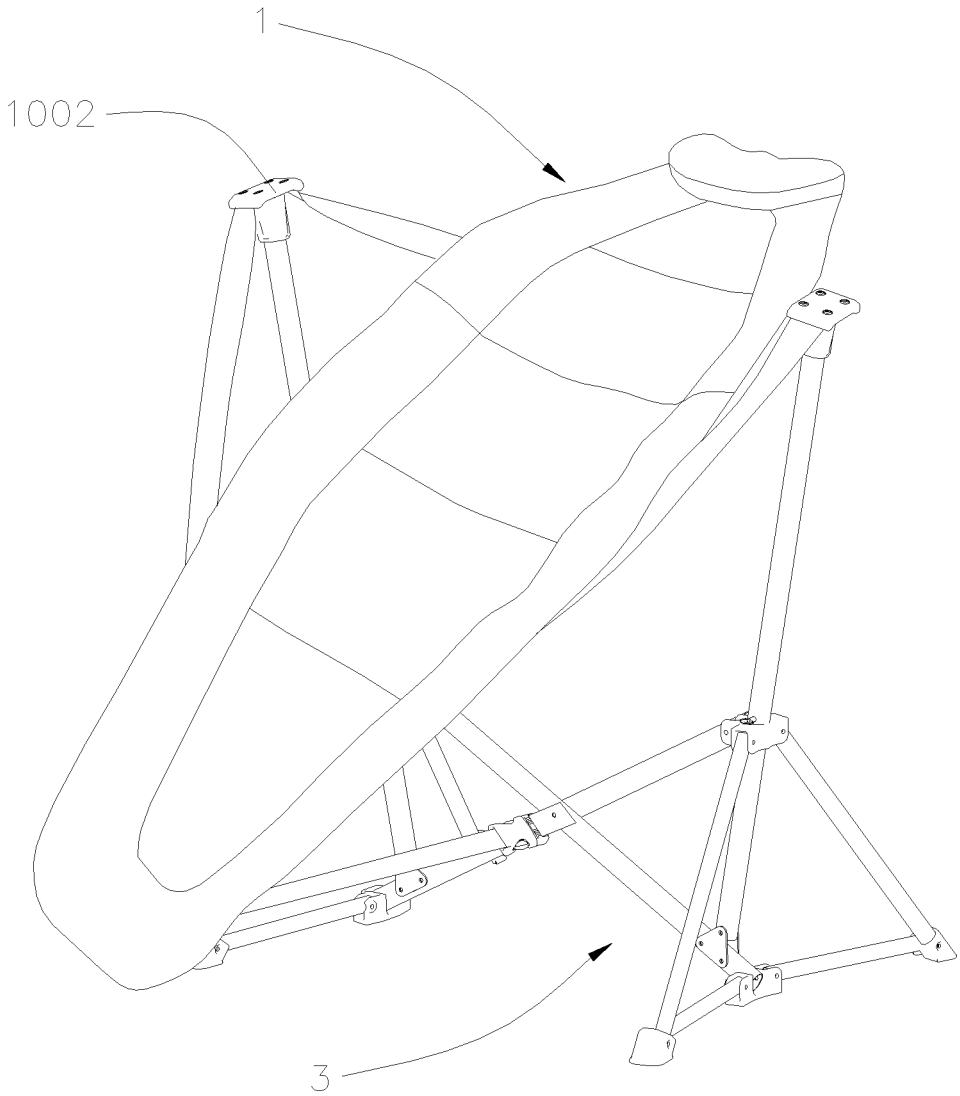
FIG. 1 is a structural view of a hammock according to Embodiment 1 of the present application.
Figure 2:
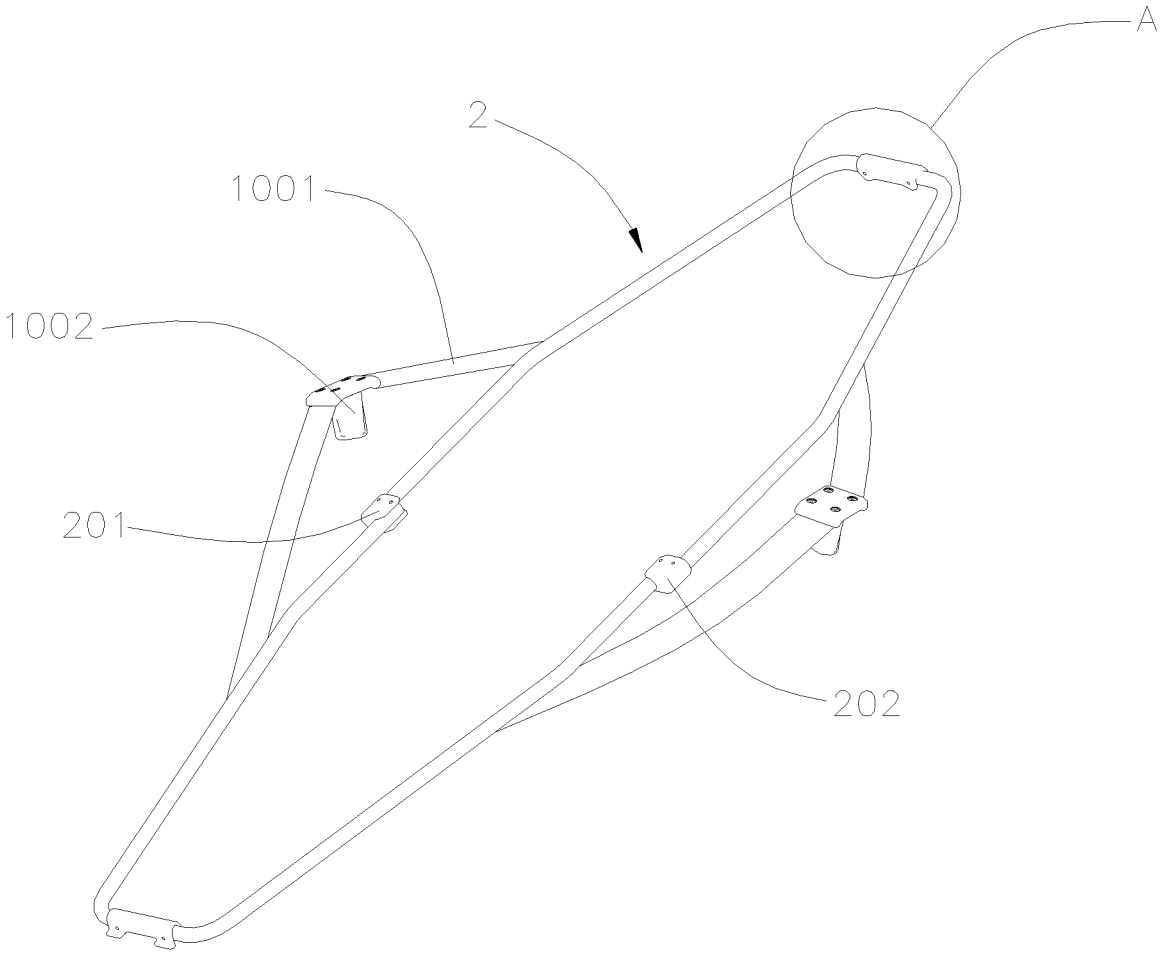
FIG. 2 is a partial structural view of the hammock according to Embodiment 1 of the present application.

Reference Numerals: 1. fabric; 2. hammock body frame; 3. hammock support; 4. first pivot shaft; 5. second pivot shaft; 6. third pivot shaft; 7. fourth pivot shaft; 8. fifth pivot shaft; 9. sixth pivot shaft; 10. hanging assembly; 1001. hanging strap; 1002. first connector; 11. pull strap; 101. central area; 102. peripheral area; 103. sleeve; 201. first middle connector; 202. second middle connector; 203. rear connector; 204. front connector; 205. first rear support rod; 206. second rear support rod; 207. first front support rod; 208. second front support rod; 301. standing post; 302. intermediate slanting post; 303. third sliding member; 304. third slanting post; 305. bottom support post; 306. second connector; 3021. first intersecting post; 3022. second intersecting post; 3023. first slanting post; 3024. second slanting post; 3025. first sliding member; 3026. second sliding member; 307. third intersecting post; 308. fourth intersecting post; 309. first supporting base; 3010. second supporting base; 3011. sixth connector; and 3012. fifth connector.

DETAILED DESCRIPTION OF THE EMBODIMENTS

The embodiments of the present application are described below in detail. Examples of the embodiments are shown in the drawings. The same or similar numerals represent the same or similar elements or elements having the same or similar functions throughout the specification. The embodiments described below with reference to the drawings are exemplary, and are merely intended to explain the present application, rather than to limit the present application.

In the description of the present application, the terms "central", "longitudinal", "transverse", "long", "wide", "thick", "upper", "lower", "front", "rear", "left", "right", "vertical", "horizontal", "top", "bottom", "inner", "outer", "axial", "radial" and "circumferential" are used to indicate orientations shown in the drawings. It should be noted that these terms are merely intended to facilitate a simple description of the present application, rather than to indicate or imply that the mentioned apparatus or elements must have the specific orientation or be constructed and operated in the specific orientation. Therefore, these terms may not be construed as a limitation to the present application.

Moreover, terms such as "first" and "second" are merely intended for the purpose of description, and should not be construed as indicating or implying relative importance. In the description of the present application, it should be noted that, unless otherwise clearly specified, meanings of terms "connected with", and "connected to" should be understood in a broad sense. For example, the connection may be a fixed connection, a removable connection, an integral connection, a mechanical connection, an electrical connection, a direct connection or an indirect connection through a medium. Those of ordinary skill in the art may understand the specific meanings of the above terms in the present application based on specific situations. In addition, in the description of the present application, unless otherwise specified, "multiple" means two or more.

Figure 3:
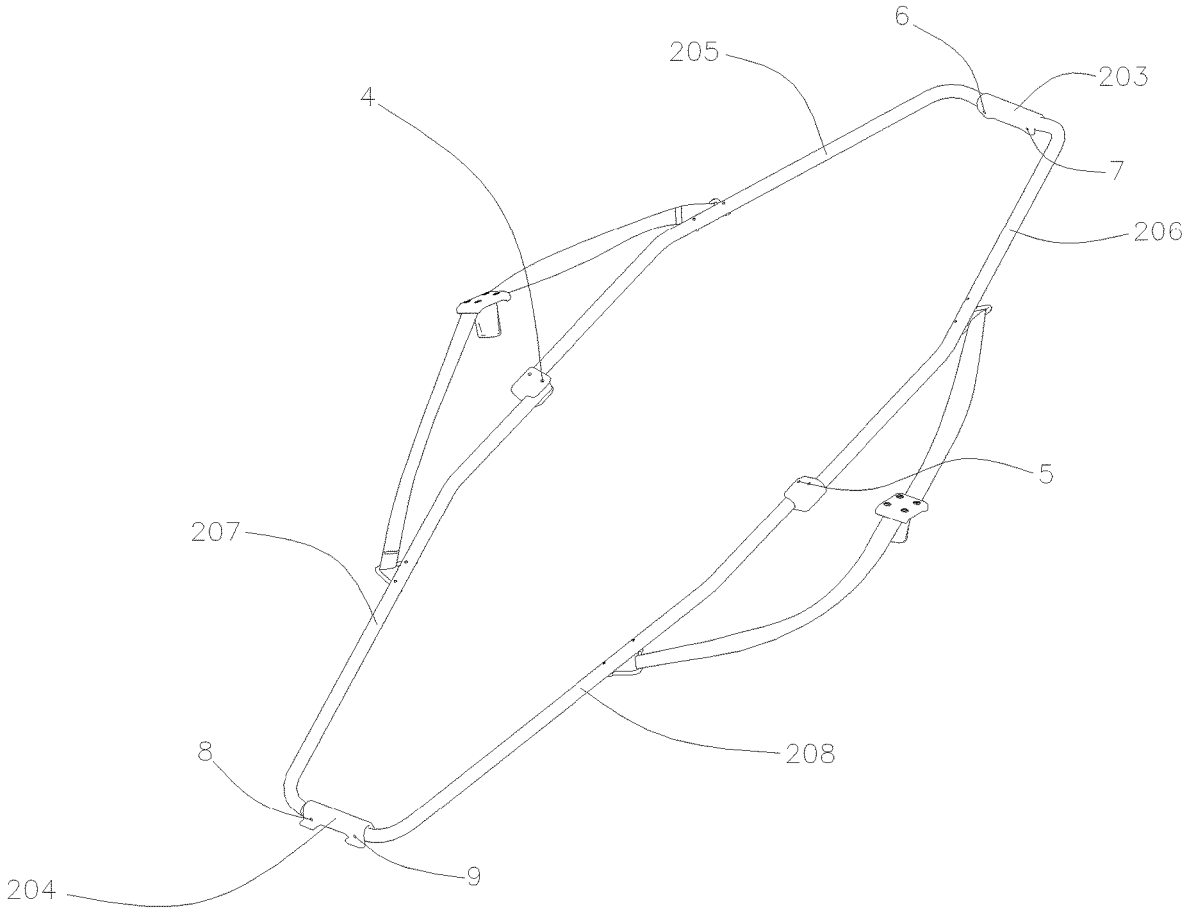
FIG. 3 is a structural view of a hammock body frame of the hammock in an unfolded state according to Embodiment 1 of the present application.
Figure 4:
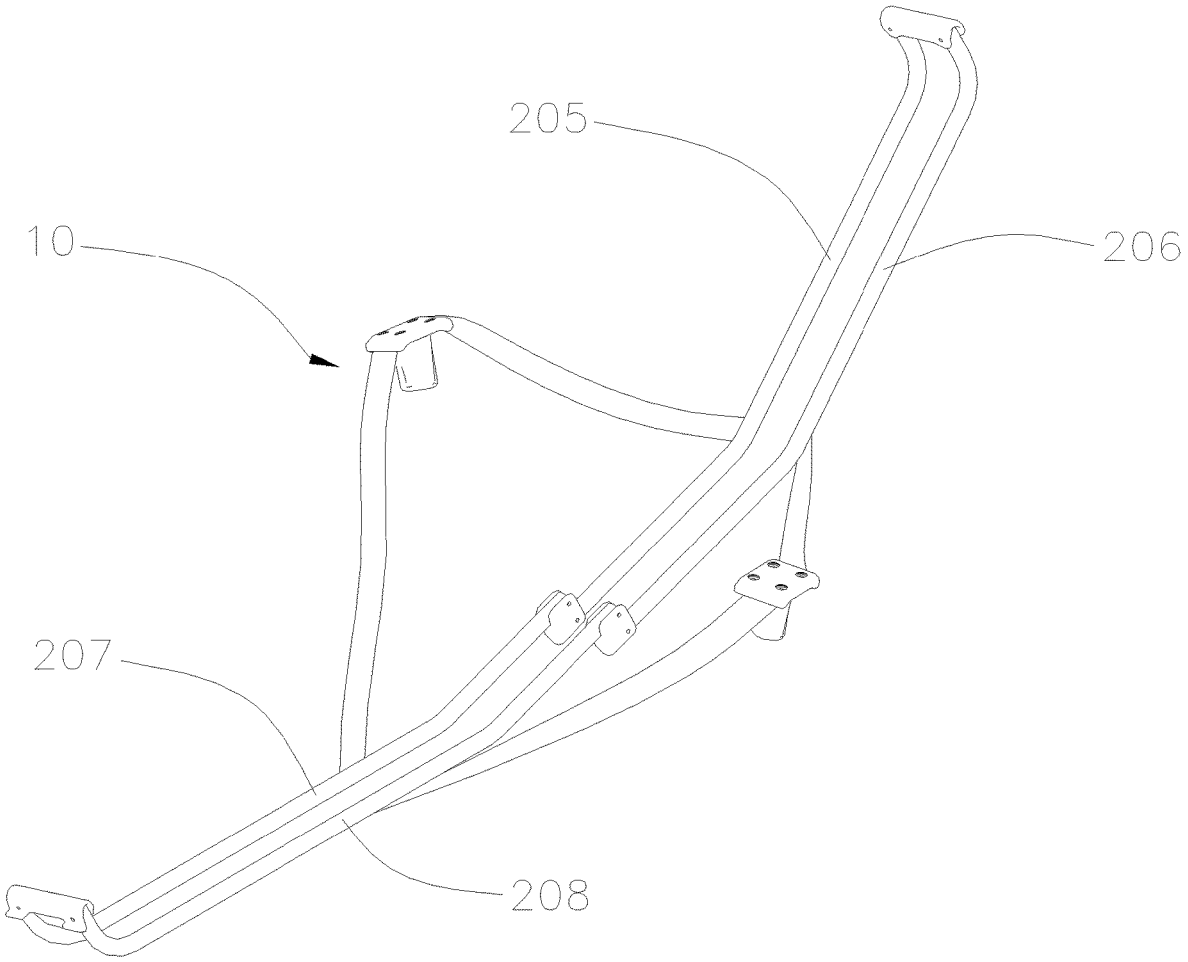
FIG. 4 is a structural view of the hammock body frame of the hammock in a half-unfolded state according to Embodiment 1 of the present application.
Figure 5:
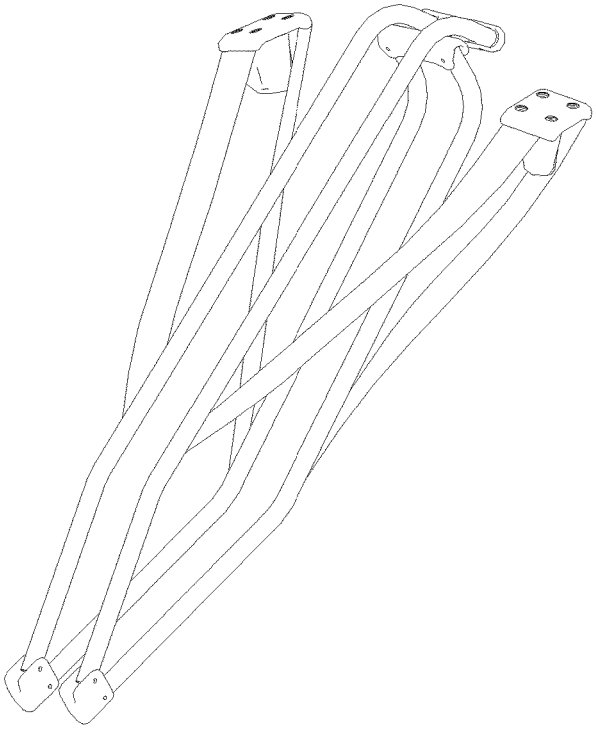
FIG. 5 is a structural view of the hammock body frame of the hammock in a fully unfolded state according to Embodiment 1 of the present application.

As shown in FIGS. 1 to 8, Embodiment 1 of the present application provides a hammock. The hammock includes a fabric 1, a hammock body frame 2 and a hammock support 3. The hammock body frame 2 includes a first middle connector 201, a second middle connector 202, a rear connector 203, a front connector 204, a first rear support rod 205, a second rear support rod 206, a first front support rod 207 and a second front support rod 208. A rear end of the first rear support rod 205 and a rear end of the second rear support rod 206 are bent toward the rear connector 203 and are pivotally connected to the rear connector 203 via a third pivot shaft 6 and a fourth pivot shaft 7 respectively. A front end of the first front support rod 207 and a front end of the second front support rod 208 are bent toward the front connector 204 and are pivotally connected to the front connector 204 via a fifth pivot shaft 8 and a sixth pivot shaft 9 respectively. A front end of the first rear support rod 205 is fixedly connected to the first middle connector 201. A rear end of the first front support rod 207 is pivotally connected to the first middle connector 201 through a first pivot shaft 4. A front end of the second rear support rod 206 is fixedly connected to the second middle connector 202. A rear end of the second front support rod 208 is pivotally connected to the second middle connector 202 through a second pivot shaft 5. As shown in FIG. 3, the hammock body frame 2 is in an unfolded state. The third pivot shaft 6 is coaxial with the fifth pivot shaft 8, and the fourth pivot shaft 7 is coaxial with the sixth pivot shaft 9. The first front support rod 207 and the first rear support rod 205 on a left side of the hammock body frame 2 rotate synchronously around the third pivot shaft 6 and the fifth pivot shaft 8, and the second front support rod 208 and the second rear support rod 206 on a right side of the hammock body frame 2 rotate synchronously around the fourth pivot shaft 7 and the sixth pivot shaft 9. The left and right halves of the hammock body frame 2 are close to each other, and the hammock body frame is changed from an unfolded state to a half-folded state. During this process, the third pivot shaft 6 and the fifth pivot shaft 8 are always coaxial, and the fourth pivot shaft 7 and the sixth pivot shaft 9 are always coaxial. As shown in FIG. 4, the hammock body frame 2 is in the half-folded state, and the first pivot shaft 4 is coaxial with the second pivot shaft 5. The first front support rod 207 and the second front support rod 208 of the front half of the hammock body frame 2 rotate synchronously to the rear half of the hammock body frame 2 around the first pivot shaft 4 and the second pivot shaft 5 respectively. The hammock body frame is changed from the half-folded state to a fully-folded state, as shown in FIG. 5. During this process, the first pivot shaft 4 and the second pivot shaft 5 are always coaxial. In this embodiment, the hammock body frame 2 is rotated about 90° from the unfolded state to the half-folded state. When the hammock body frame 2 is in the half-folded state, the first pivot shaft 4 and the second pivot shaft 5 are coaxial. When the hammock body frame 2 is unfolded, both the first pivot shaft 4 and the second pivot shaft 5 can rotate around other pivot shafts. In the unfolded state, the first pivot shaft 4 and the second pivot shaft 5 are parallel, and the upper and lower halves of the hammock body frame 2 cannot rotate relatively. When the hammock body frame 2 enters an initial stage of the unfolded state from the half-folded state, the first pivot shaft 4 and the second pivot shaft 5 are no longer coaxial, and the upper and lower halves of the hammock body frame 2 cannot be folded. Similarly, when the hammock body frame 2 enters an initial stage of the fully folded state from the half-folded state, the third pivot shaft 6 and the fifth pivot shaft 8 are no longer coaxial, the fourth pivot shaft 7 and the sixth pivot shaft 9 are no longer coaxial, and the left and right halves of the hammock body frame 2 cannot rotate relatively. Through this design, when the hammock body frame 2 is in the unfolded state, the hammock body frame will not collapse. When the hammock body frame is fully folded, the hammock body frame has a compact structure and is not easy to loosen.

Figure 6:
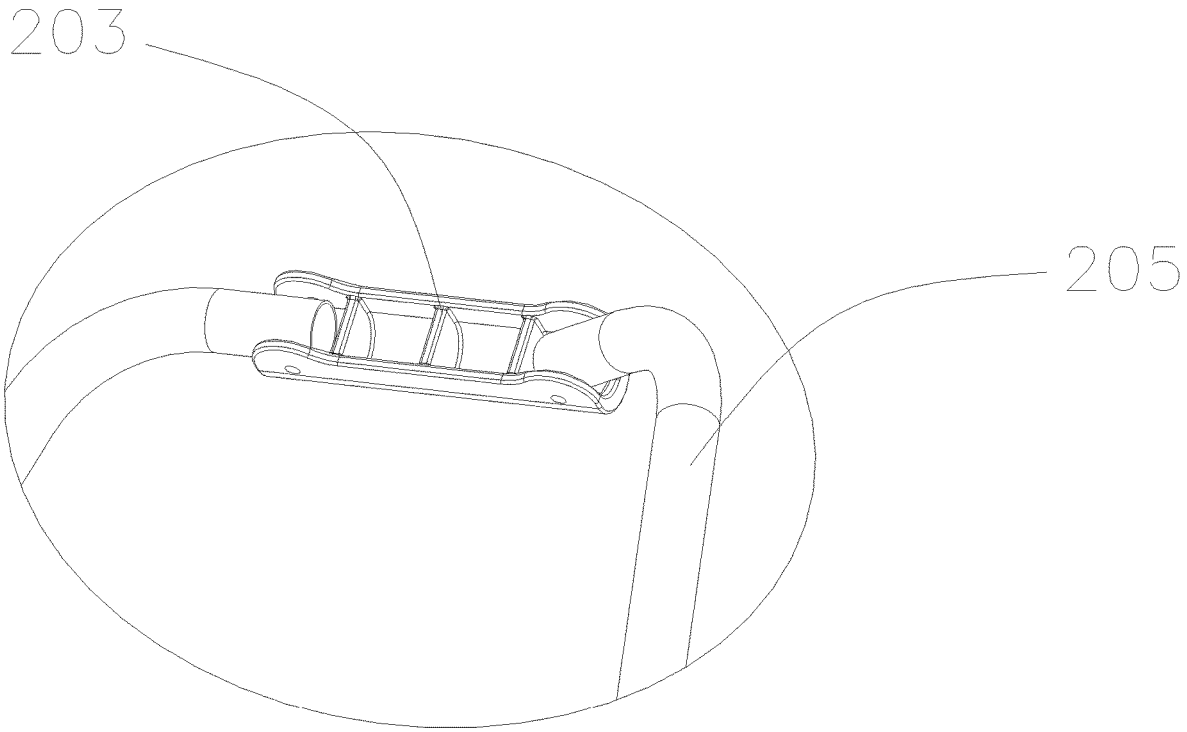
FIG. 6 is an enlarged view of a rear side of A shown in FIG. 2.

The front connector 204 and the rear connector 203 are provided with notches, and ends of the support rods are inserted into the notches to form blocking portions, which act as limiting portions to limit the rotation of the support rods. For example, as shown in FIG. 6, the rear end of the first rear support rod 205 is inserted into a notch of the rear connector 203, the third pivot shaft 6 passes through the rear connector 203 and the rear end of the first rear support rod 205, and the first rear support rod 205 can rotate around the third pivot shaft 6. The blocking portion of the rear connector 203 can limit the rear end of the first rear support rod 205 in the unfolded state, such that the first rear support rod cannot rotate further, so as to maintain the hammock body frame 2 in a stable state. The first middle connector 201 and the second middle connector 202 are also provided with notches. The rear end of the first front support rod 207 and the rear end of the second rear support rod 206 are respectively pivotally connected in the notches. When the hammock body frame 2 is in the unfolded state, the half-folded state and the intermediate state, the blocking portions of the first middle connector 201 prevent the first rear support rod 205 and the first front support rod 207 from being relatively unfolded, and the blocking portions of the second middle connector 202 prevent the second rear support rod 206 and the second front support rod 208 from being relatively unfolded.

Figure 7:
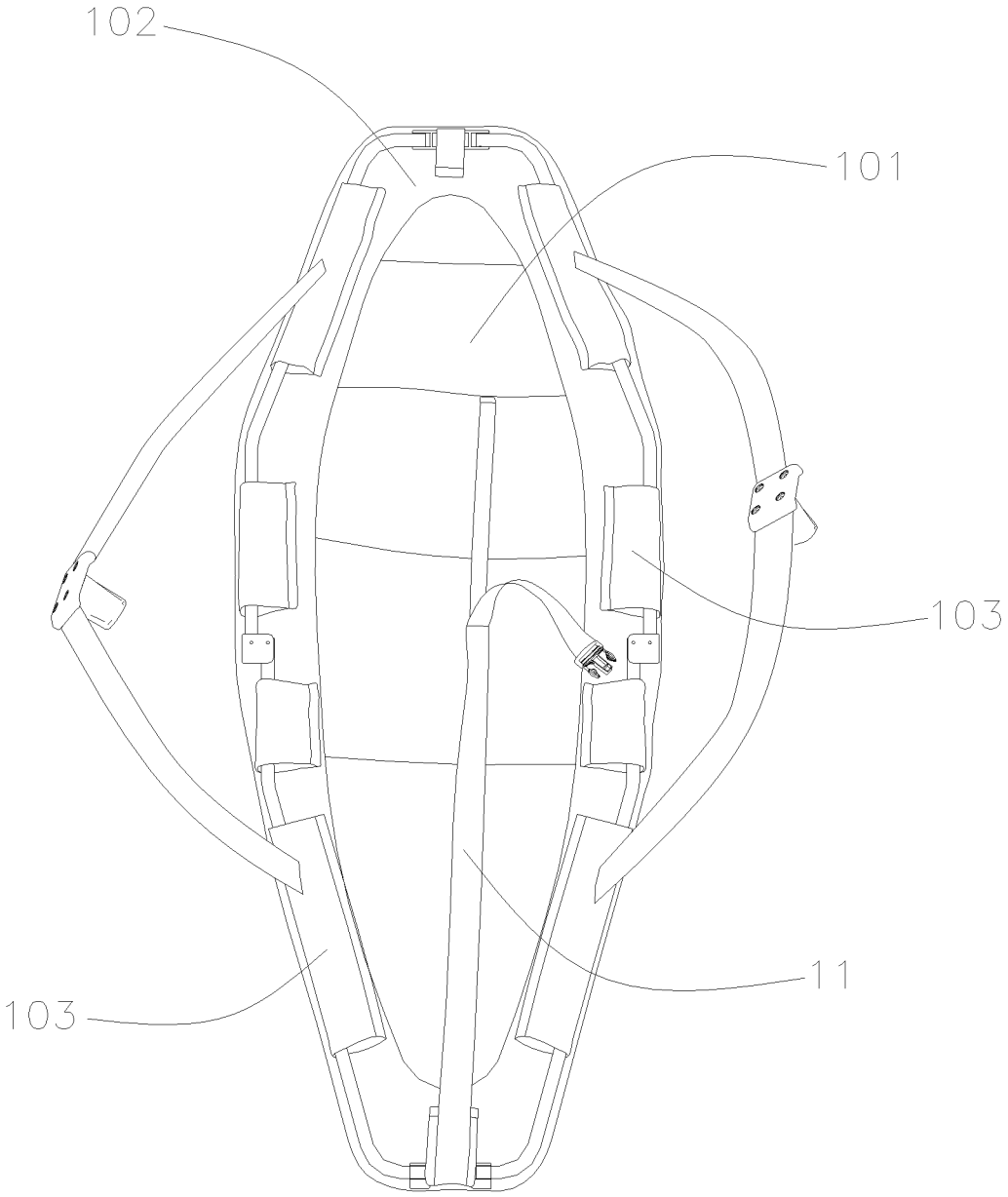
FIG. 7 is another partial structural view of the hammock according to Embodiment 1 of the present application.

The fabric 1 is made of a flexible material, such as cloth or flexible plastic. As shown in FIG. 7, the fabric 1 includes a central area 101 and a peripheral area 102. The peripheral area 102 surrounds the central area 101 and bulges with respect to the central area 101. The central area 101 includes multiple united pieces. Two adjacent united pieces are spliced together, and a periphery of the multiple united pieces is fixed to the peripheral area 102. An edge of each of the united pieces at a splicing joint has a length greater than a straight-line distance between two ends of the edge. That is, the central area 101 is recessed at the splicing joint to make a user lying on the fabric feel comfortable.

The fabric 1 and the hammock body frame 2 are fixedly connected. In this embodiment, multiple sleeves 103 are provided at the bottom of the peripheral area 102 of the fabric 1. The sleeves 103 wrap the first rear support rod 205, the second rear support rod 206, the first front support rod 207 and the second front support rod 208, respectively.

Figure 8:
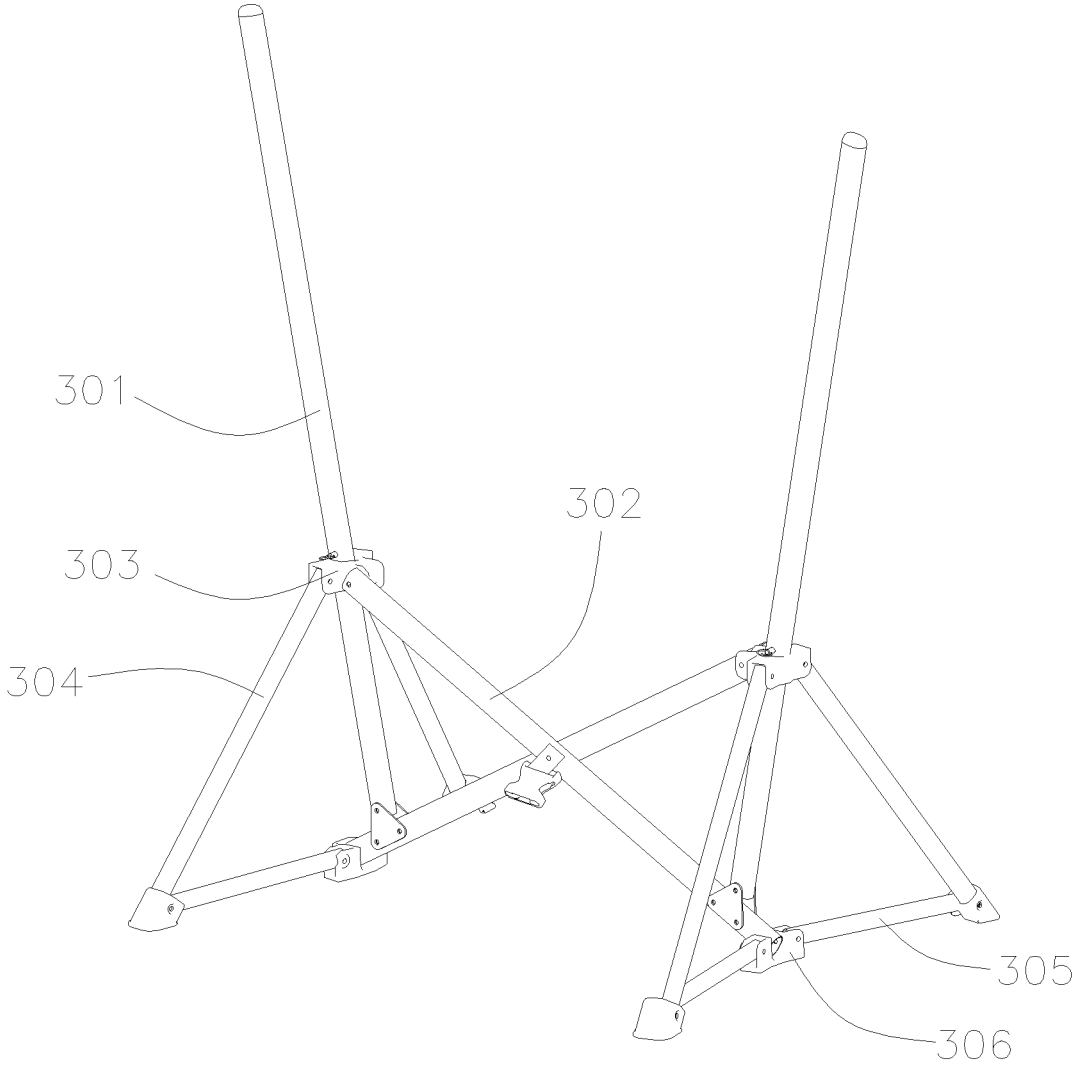
FIG. 8 is a structural view of a hammock support of the hammock according to Embodiment 1 of the present application.
Figure 9:
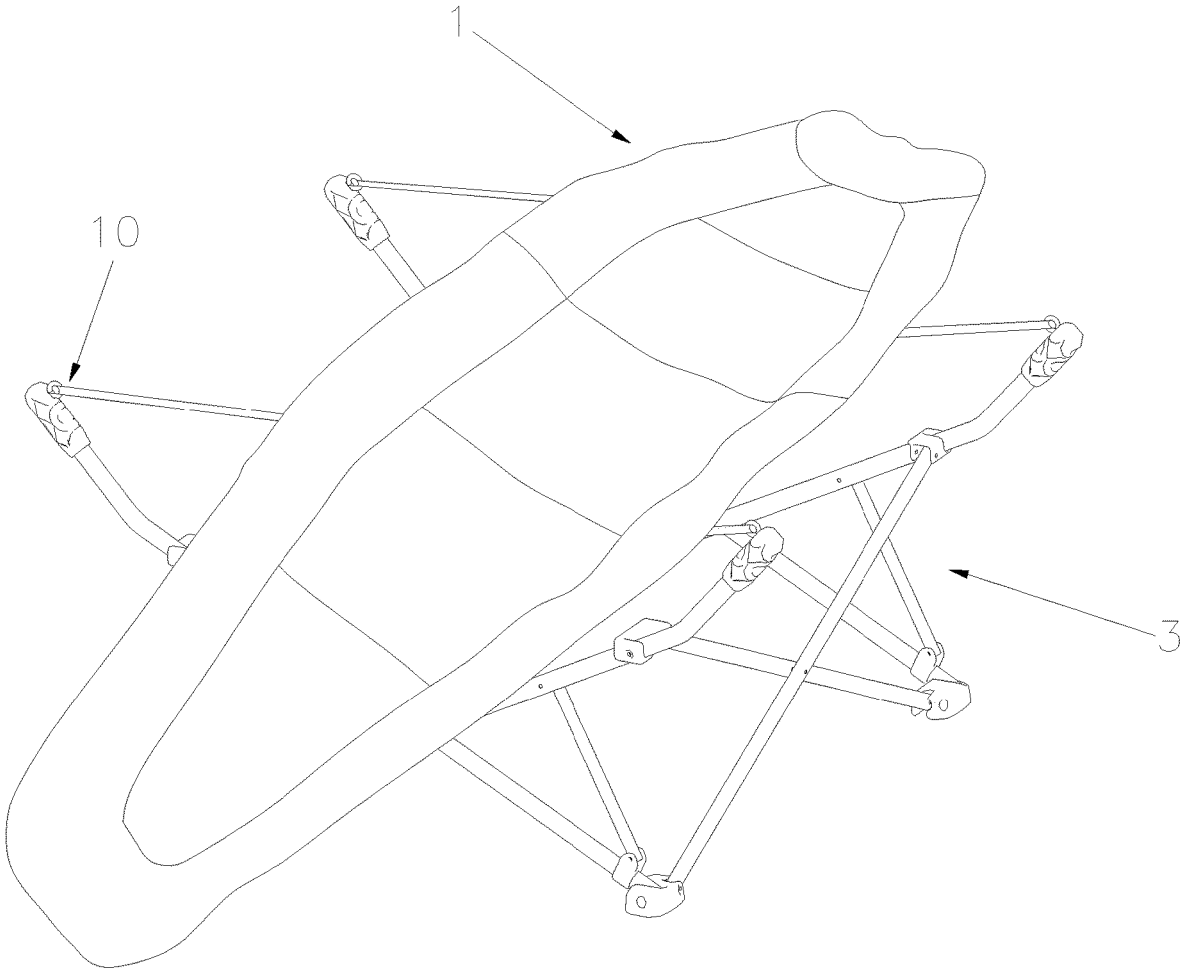
FIG. 9 is a structural view of a hammock according to Embodiment 2 of the present application.

As shown in FIG. 8, in this embodiment, the hammock support 3 includes two standing posts 301 and a transverse connection assembly. The two standing posts 301 are connected through the transverse connection assembly and are spaced apart. Specifically, the transverse connection assembly includes two intersecting and hinged intermediate slanting posts 302. The standing posts 301 are respectively nested in two third sliding members 303 in a sliding manner. Upper ends of the two intermediate slanting posts 302 are respectively hinged to the two third sliding members 303, and lower ends of the two intermediate slanting posts 302 are respectively hinged to lower ends of the two standing posts 301. The third sliding members 303 each are further hinged to two mirror-symmetric third slanting posts 304. Lower ends of the two third slanting posts 304 are respectively hinged to two bottom support posts 305. Ends of the two bottom support posts 305 are hinged through a second connector 306, and lower ends of the intermediate slanting posts 302 are respectively hinged to second connectors 306. In this way, the entire hammock support 3 is foldaway.

In this embodiment, the standing posts 301 are respectively provided with hanging assembly 10. The two hanging assemblies 10 are respectively located on two sides of the hammock body frame 2. The hanging assemblies 10 each include hanging straps 1001 and a first connector 1002. The first connector 1002 is connected between two ends of the hanging straps 1001. The first connector 1002 is connected to an upper end of a corresponding standing post 301, and two ends of the hanging straps 1001 are fixed at a bottom of the fabric 1. In this embodiment, the first connector 1002 is provided with a recess. The upper end of the standing post 301 is inserted into the recess, such that the standing post 301 and the first connector 1002 are detachably fixed. In other embodiments, the first connector 1002 may be fixed to the standing post 301 by a screw. In some other embodiments, the first connector 1002 is provided with a protrusion that is able to be inserted into an opening at the upper end of the standing post 301, such that the standing post 301 and the connector are detachably fixed. In some other embodiments, the two ends of the hanging straps 1001 are fixed to the hammock body frame 2.

In order to prevent the user from tipping rearwards when lying on the hammock, the hammock further includes a pull strap 11 made of a flexible material. The length of the pull strap 11 is adjustable by an adjustment buckle similar to that on a backpack. A front end of the pull strap 11 is connected to a front end of the fabric 1 or a front end of the hammock body frame 2, and a rear end of the pull strap 11 is connected to the transverse connection assembly.

According to some other embodiments, there are four standing posts 301, and two standing posts 301 are provided on each of left and right sides of a hammock body. There are also four hanging assemblies 10. The first connector 1002 is connected to the standing post 301. The first connector 1002 is fixed to ends of the hanging straps 1001, and the other ends of the hanging straps 1001 are fixedly connected to the fabric 1 or the hammock body frame 2.

Figure 11:
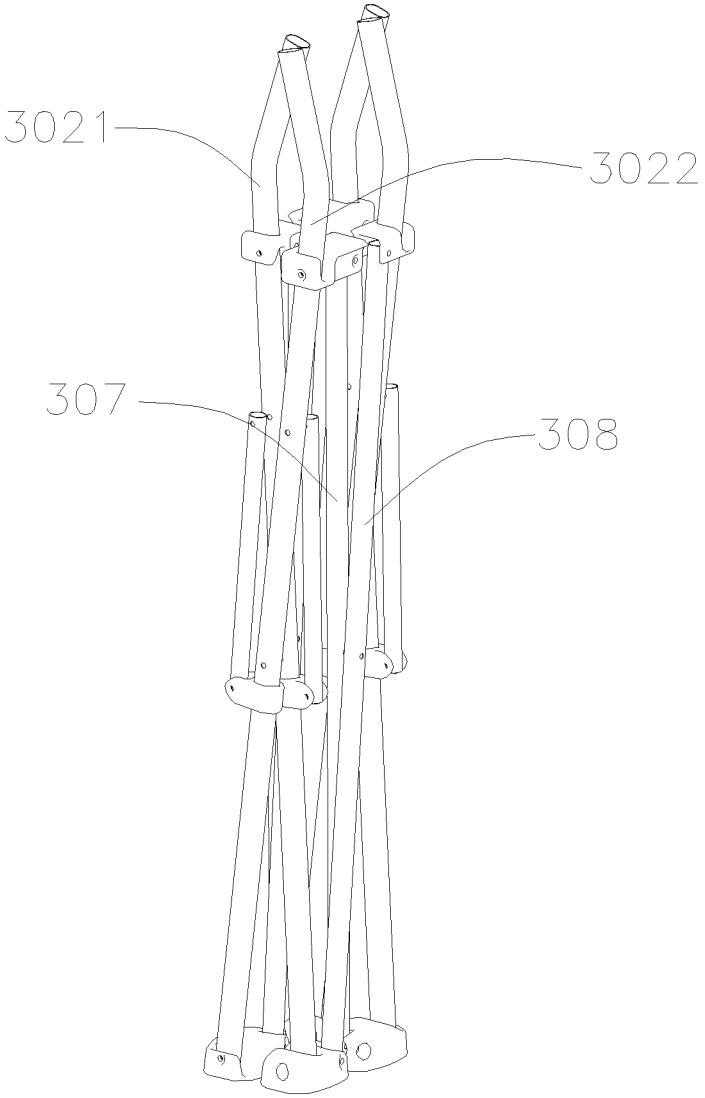
FIG. 11 is a structural view of the hammock support of the hammock in a folded state according to Embodiment 2 of the present application.
Figure 12:
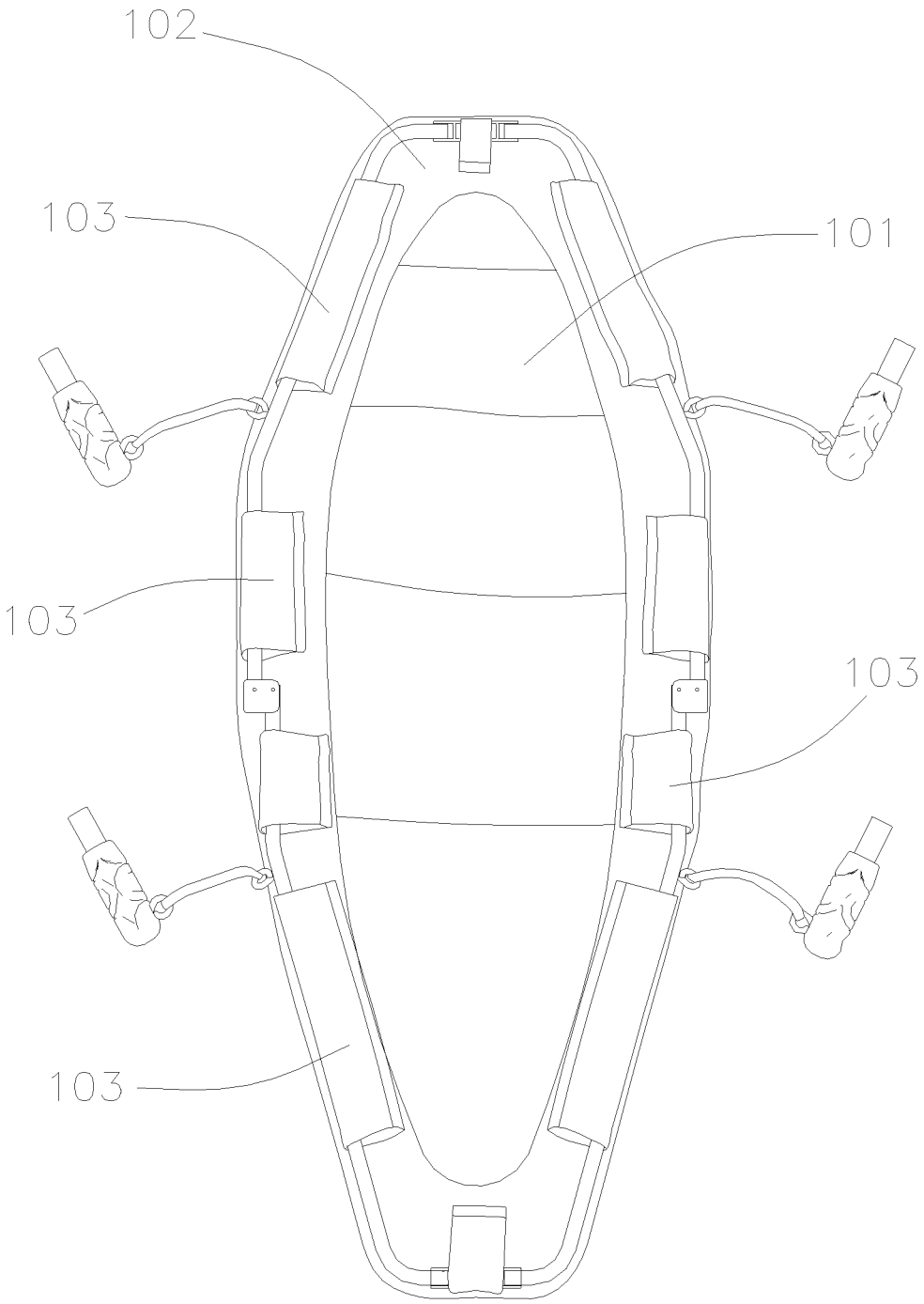
FIG. 12 is a structural view of a hammock body and hanging assemblies of the hammock according to Embodiment 2 of the present application.
Figure 13:
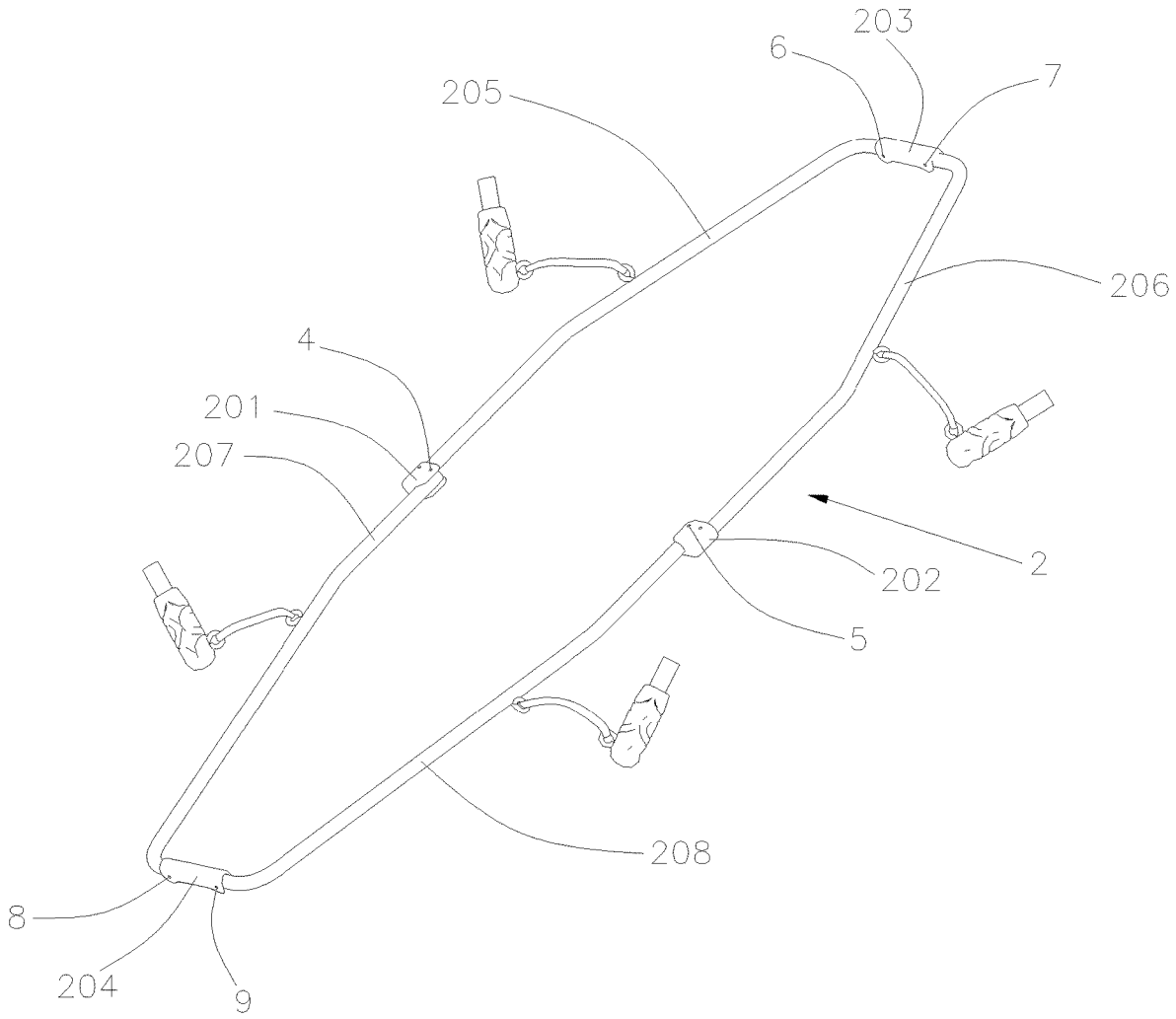
FIG. 13 is a structural view of the hammock body frame of the hammock in an unfolded state and the hanging assemblies according to Embodiment 2 of the present application.
Figure 14:
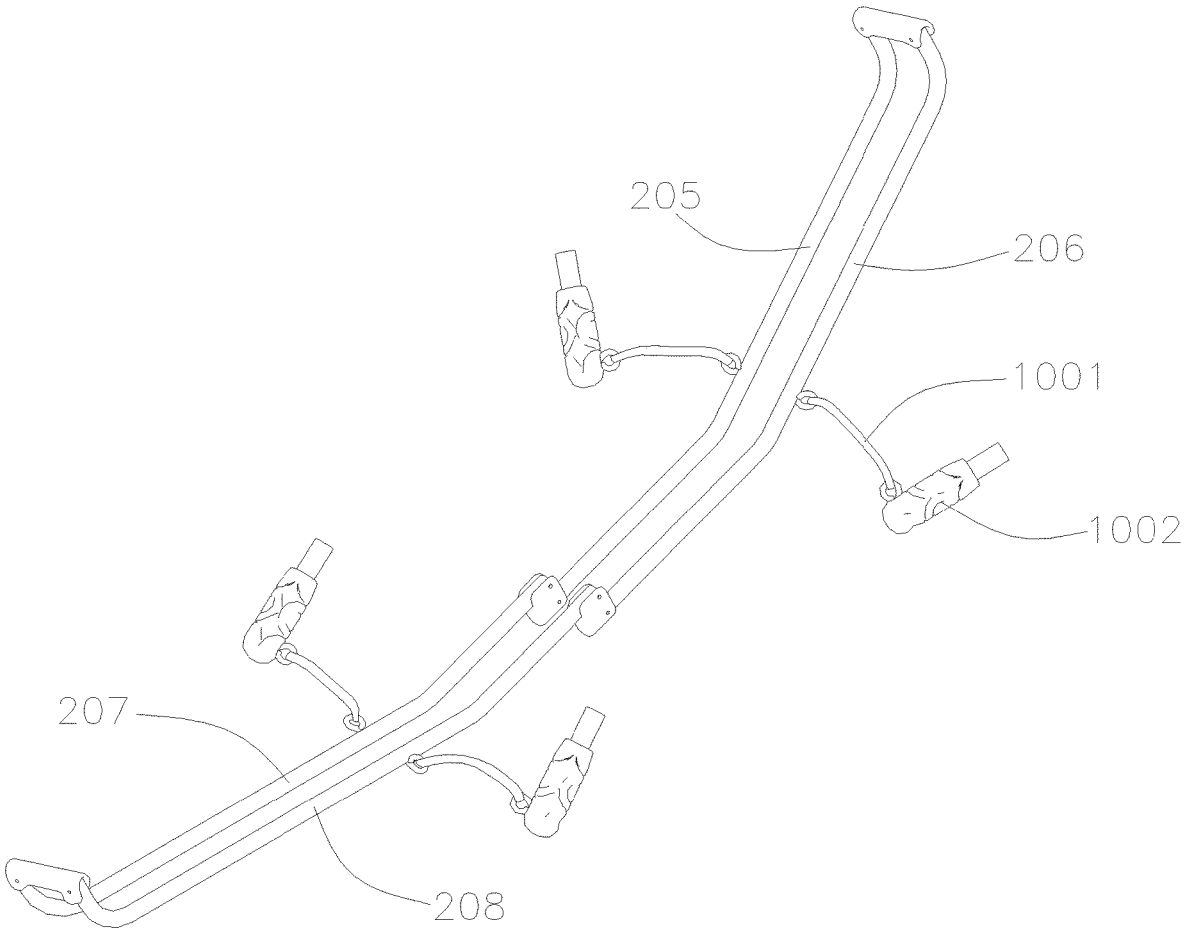
FIG. 14 is a structural view of the hammock body frame of the hammock in a half-folded state and the hanging assemblies according to Embodiment 2 of the present application.
Figure 15:
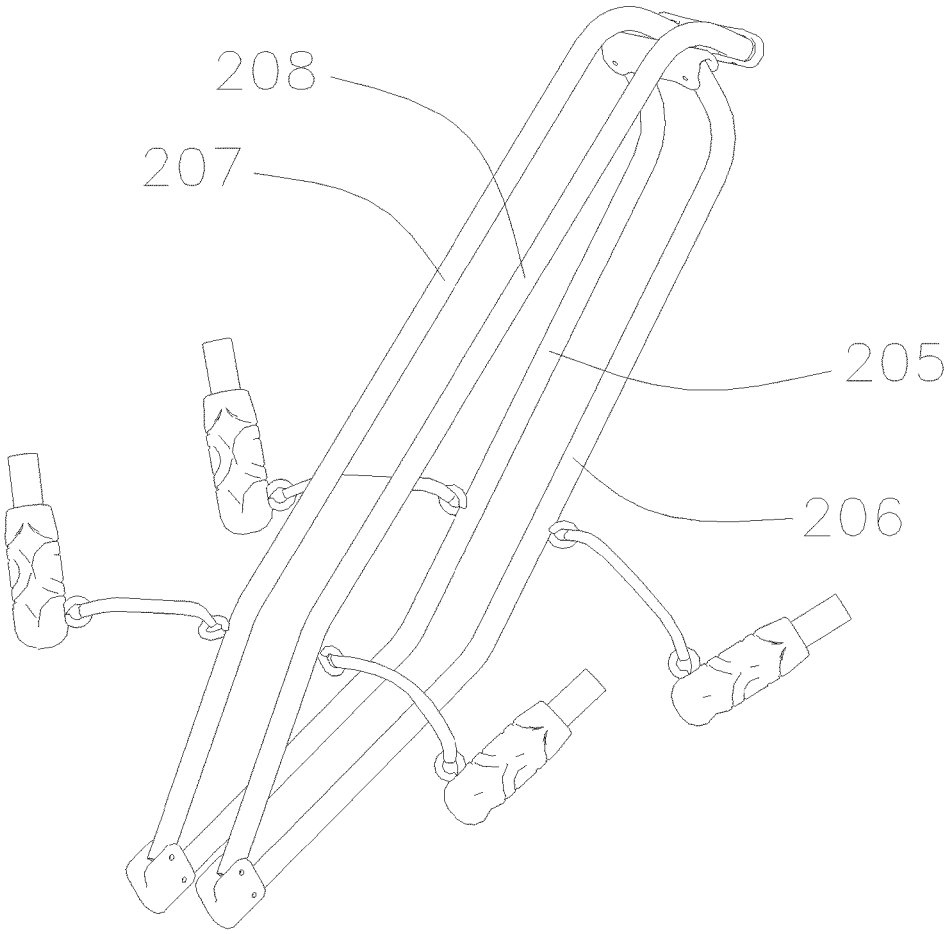
FIG. 15 is a structural view of the hammock body frame of the hammock in a fully folded state and the hanging assemblies according to Embodiment 2 of the present application.

As shown in FIGS. 9 to 16, Embodiment 2 of the present application provides a hammock. The hammock includes a fabric 1, a hammock body frame 2 and a hammock support 3. The hammock body frame 2 includes a first middle connector 201, a second middle connector 202, a rear connector 203, a front connector 204, a first rear support rod 205, a second rear support rod 206, a first front support rod 207 and a second front support rod 208. A rear end of the first rear support rod 205 and a rear end of the second rear support rod 206 are bent toward the rear connector 203 and are pivotally connected to the rear connector 203 via a third pivot shaft 6 and a fourth pivot shaft 7 respectively. A front end of the first front support rod 207 and a front end of the second front support rod 208 are bent toward the front connector 204 and are pivotally connected to the front connector 204 via a fifth pivot shaft 8 and a sixth pivot shaft 9 respectively. A front end of the first rear support rod 205 is fixedly connected to the first middle connector 201. A rear end of the first front support rod 207 is pivotally connected to the first middle connector 201 through a first pivot shaft 4. A front end of the second rear support rod 206 is fixedly connected to the second middle connector 202. A rear end of the second front support rod 208 is pivotally connected to the second middle connector 202 through a second pivot shaft 5. As shown in FIG. 13, the hammock body frame 2 is in an unfolded state. The third pivot shaft 6 is coaxial with the fifth pivot shaft 8, and the fourth pivot shaft 7 is coaxial with the sixth pivot shaft 9. The first front support rod 207 and the first rear support rod 205 on a left side of the hammock body frame 2 rotate synchronously around the third pivot shaft 6 and the fifth pivot shaft 8, and the second front support rod 208 and the second rear support rod 206 on a right side of the hammock body frame 2 rotate synchronously around the fourth pivot shaft 7 and the sixth pivot shaft 9. The left and right halves of the hammock body frame 2 are close to each other, and the hammock body frame is changed from an unfolded state to a half-folded state. During this process, the third pivot shaft 6 and the fifth pivot shaft 8 are always coaxial, and the fourth pivot shaft 7 and the sixth pivot shaft 9 are always coaxial. As shown in FIG. 14, the hammock body frame 2 is in the half-folded state, and the first pivot shaft 4 is coaxial with the second pivot shaft 5. The first front support rod 207 and the second front support rod 208 of the front half of the hammock body frame 2 rotate synchronously to the rear half of the hammock body frame 2 around the first pivot shaft 4 and the second pivot shaft 5 respectively. The hammock body frame is changed from the half-folded state to a fully-folded state, as shown in FIG. 15. During this process, the first pivot shaft 4 and the second pivot shaft 5 are always coaxial. In this embodiment, the hammock body frame 2 is rotated about 90° from the unfolded state to the half-folded state. When the hammock body frame 2 is in the half-folded state, the first pivot shaft 4 and the second pivot shaft 5 are coaxial. When the hammock body frame 2 is unfolded, both the first pivot shaft 4 and the second pivot shaft 5 can rotate around other pivot shafts. In the unfolded state, the first pivot shaft 4 and the second pivot shaft 5 are parallel, and the upper and lower halves of the hammock body frame 2 cannot rotate relatively. When the hammock body frame 2 enters an initial stage of the unfolded state from the half-folded state, the first pivot shaft 4 and the second pivot shaft 5 are no longer coaxial, and the upper and lower halves of the hammock body frame 2 cannot be folded. Similarly, when the hammock body frame 2 enters an initial stage of the fully folded state from the half-folded state, the third pivot shaft 6 and the fifth pivot shaft 8 are no longer coaxial, the fourth pivot shaft 7 and the sixth pivot shaft 9 are no longer coaxial, and the left and right halves of the hammock body frame 2 cannot rotate relatively. Through this design, when the hammock body frame 2 is in the unfolded state, the hammock body frame will not collapse. When the hammock body frame is fully folded, the hammock body frame has a compact structure and is not easy to loosen.

Figure 16:
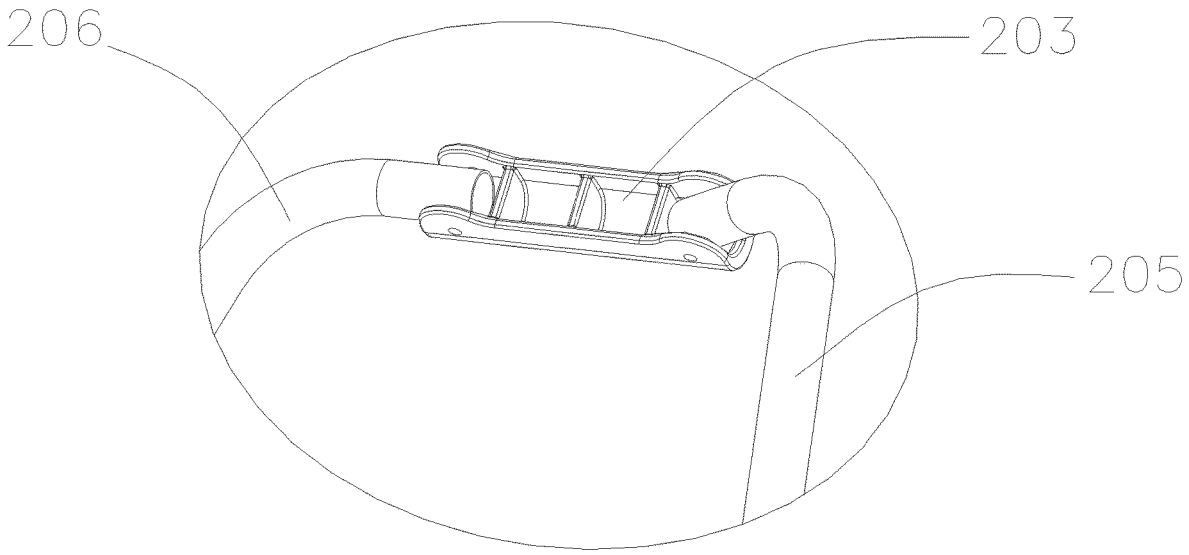
FIG. 16 is a partially enlarged structural view of the hammock according to Embodiment 2 of the present application.

The front connector 204 and the rear connector 203 are provided with notches, and ends of the support rods are inserted into the notches to form blocking portions, which act as limiting portions to limit the rotation of the support rods. For example, as shown in FIG. 16, the rear end of the first rear support rod 205 is inserted into a notch of the rear connector 203, the third pivot shaft 6 passes through the rear connector 203 and the rear end of the first rear support rod 205, and the first rear support rod 205 can rotate around the third pivot shaft 6. The blocking portion of the rear connector 203 can limit the rear end of the first rear support rod 205 in the unfolded state, such that the first rear support rod cannot rotate further, so as to maintain the hammock body frame 2 in a stable state. The first middle connector 201 and the second middle connector 202 are also provided with notches. The rear end of the first front support rod 207 and the rear end of the second front support rod 208 are respectively pivotally connected in the notches. When the hammock body frame 2 is in the unfolded state, the half-folded state and the intermediate state, the blocking portions of the first middle connector 201 prevent the first rear support rod 205 and the first front support rod 207 from being relatively unfolded, and the blocking portions of the second middle connector 202 prevent the second rear support rod 206 and the second front support rod 208 from being relatively unfolded.

The fabric 1 is made of a flexible material, such as cloth or flexible plastic. As shown in FIG. 12, the fabric 1 includes a central area 101 and a peripheral area 102. The peripheral area 102 surrounds the central area 101 and bulges with respect to the central area 101. The central area 101 includes multiple united pieces. Two adjacent united pieces are spliced together, and a periphery of the multiple united pieces is fixed to the peripheral area 102. An edge of each of the united pieces at a splicing joint has a length greater than a straight-line distance between two ends of the edge. That is, the central area 101 is recessed at the splicing joint to make a user lying on the fabric feel comfortable.

The fabric 1 and the hammock body frame 2 are fixedly connected. In this embodiment, multiple sleeves 103 are provided at the bottom of the peripheral area 102 of the fabric 1. The sleeves 103 wrap the first rear support rod 205, the second rear support rod 206, the first front support rod 207 and the second front support rod 208, respectively.

Figure 10:
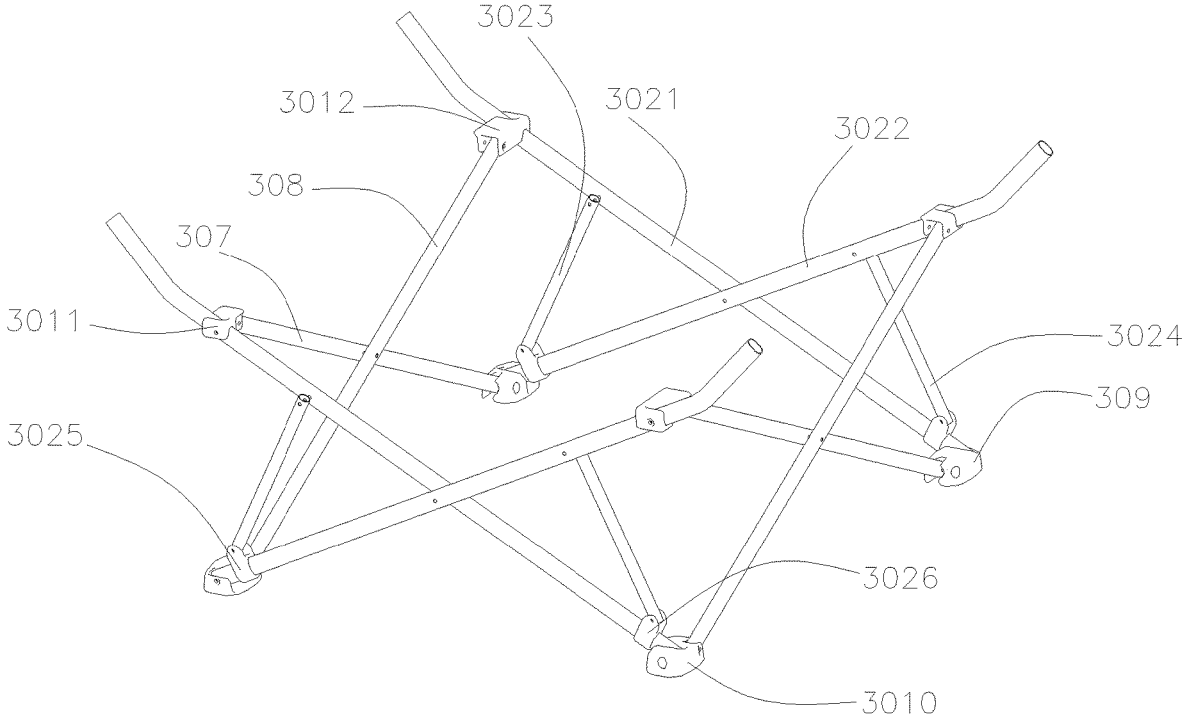
FIG. 10 is a structural view of a hammock support of the hammock in an unfolded state according to Embodiment 2 of the present application.

As shown in FIG. 10, in this embodiment, the hammock support 3 includes two mirror-symmetric first supporting mechanisms. The first supporting mechanisms each include: a first intersecting post 3021, a second intersecting post 3022, a first slanting post 3023 and a second slanting post 3024.

The first intersecting post 3021 and the second intersecting post 3022 intersect and are hinged at an intersection.

One end of the first slanting post 3023 is hinged to the first intersecting post 3021, and the other end of the first slanting post 3023 is hinged to a first sliding member 3025 slidably fit with the second intersecting post 3022.

One end of the second slanting post 3024 is hinged to the second intersecting post 3022, and the other end of the second slanting post 3024 is hinged to a second sliding member 3026 slidably fit with the first intersecting post 3021. As shown in FIGS. 10 and 11, when the hammock support 3 is folded, an upper end of the first intersecting post 3021 and an upper end of the second intersecting post 3022 are close to each other, and the first sliding member 3025 and the second sliding member 3026 slide upward. When the hammock support 3 is unfolded, the upper end of the first intersecting post 3021 and the upper end of the second intersecting post 3022 are far away from each other, and the first sliding member 3025 and the second sliding member 3026 slide downward, and are finally blocked by supporting bases.

The hammock support 3 further includes two mirror-symmetric second supporting mechanisms. The second supporting mechanisms each include a third intersecting post 307 and a fourth intersecting post 308 that interest and are hinged at an intersection.

Upper ends of two third intersecting posts 307 are respectively hinged to two sixth connectors 3011. The two sixth connectors 3011 are respectively hinged to the first intersecting post 3021 and the second intersecting post 3022 on a front side. Lower ends of the two third intersecting posts 307 are respectively hinged to two first supporting bases 309. A lower end of the first intersecting post 3021 and a lower end of the second intersecting post 3022 on a rear side are respectively hinged to the two first supporting bases 309.

Upper ends of two fourth intersecting posts 308 are respectively hinged to two fifth connectors 3012. The two fifth connectors 3012 are respectively hinged to the first intersecting post 3021 and the second intersecting post 3022 on the rear side. Lower ends of the two fourth intersecting posts 308 are respectively hinged to two second supporting bases 3010. A lower end of the first intersecting post 3021 and a lower end of the second intersecting post 3022 on the front side are respectively hinged to the two second supporting bases 3010.

Hanging assemblies 10 each include a hanging strap 1001 and a first connector 1002. One end of the hanging strap 1001 is connected to an edge of the fabric 1 or the hammock body frame 2. In this embodiment, ends of four hanging straps 1001 are fixedly connected to the first rear support rod 205, the second rear support rod 206, the first front support rod 207 and the second front support rod 208 respectively, and the other ends of the hanging straps 1001 are connected to first connectors 1002 respectively. The first connectors 1002 on the left side of the hammock body are connected to the upper ends of the two first intersecting posts 3021, and the first connectors 1002 on the right side of the hammock body are connected to the upper ends of the two second intersecting posts 3022. The upper ends of the first intersecting posts 3021 and the upper ends of the second intersecting posts 3022 are slightly bent toward an inner side of the hammock, and are respectively provided with recesses. The first connectors 1002 each are provided with a protrusion that is able to be inserted into a corresponding recess. In other embodiments, the first connectors 1002 are respectively provided with recesses, and the upper ends of the first intersecting posts 3021 and the upper ends of the second intersecting posts 3022 are respectively inserted into the recesses, such that the intersecting posts and the first connectors 1002 are detachably fixed.

In the description of this specification, the description with reference to the terms such as "one embodiment", "some embodiments", "an example", "a specific example", or "some examples" means that the specific features, structures, materials, or characteristics described with reference to the embodiment or example are included in at least one embodiment or example of the present application. In this specification, the schematic description of the above terms does not necessarily refer to the same embodiment or example. Moreover, the specific features, structures, materials or characteristics described may be combined in any suitable manner in any one or more embodiments or examples.

Inspired by the above ideal embodiments of the present application, those skilled in the art can make various changes and modifications through the above description without departing from the scope of the technical idea of the present application. The technical scope of the present application is subjected to the scope of the claims, and is not limited to the content of the specification.

What is claimed is:

1. A hammock, comprising a hammock body and a hammock support, wherein the hammock body comprises a fabric and a hammock body frame; the fabric is made of a flexible material and is fixedly connected to the hammock body frame; the hammock body is connected to the hammock support through hanging assemblies; and the hammock body frame is longitudinally foldable from an unfolded state to a half-folded state and transversely foldable from the half-folded state to a fully folded state;

wherein the hammock support comprises two mirror-symmetric first supporting mechanisms; and the two mirror-symmetric first supporting mechanisms each comprise:

a first intersecting post and a second intersecting post, the first intersecting post and the second intersecting post are intersecting and hinged at an intersection;

a first slanting post, wherein a first end of the first slanting post is hinged to the first intersecting post, and a second end of the first slanting post is hinged to a first sliding member slidably fit with the second intersecting post; and a second slanting post, wherein a first end of the second slanting post is hinged to the second intersecting post, and a second end of the second slanting post is hinged to a second sliding member slidably fit with the first intersecting post;

the hammock support further comprises two mirror-symmetric second supporting mechanisms; and the two mirror-symmetric second supporting mechanisms are connected between the two first supporting mechanisms, to allow the two first supporting mechanisms to move toward and away from each other; and a left side of the hammock body is connected to two first intersecting posts through two left hanging assemblies, and a right side of the hammock body are connected to two second intersecting posts through two right hanging assemblies.

2. The hammock according to claim 1, wherein the hammock body frame comprises a first rear support rod, a second rear support rod, a first front support rod and a second front support rod; a rear end of the first rear support rod is hinged to a rear end of the second rear support rod; a front end of the first front support rod is hinged to a front end of the second front support rod; a front end of the first rear support rod and a rear end of the first front support rod are pivotally connected through a first pivot shaft; a front end of the second rear support rod and a rear end of the second front support rod are pivotally connected through a second pivot shaft; and when the hammock body frame is in the half-folded state, the fully folded state or a half-folded-to-fully-folded state, the first pivot shaft and the second pivot shaft are coaxial.

3. The hammock according to claim 2, wherein the hammock body frame further comprises a rear connector and a front connector; the rear end of the first rear support rod and the rear end of the second rear support rod are pivotally connected to the rear connector through a third pivot shaft and a fourth pivot shaft respectively; the front end of the first front support rod and the front end of the second front support rod are pivotally connected to the front connector through a fifth pivot shaft and a sixth pivot shaft respectively; and when the hammock body frame is in the unfolded state, the half-folded state or an unfolded-to-half-folded state, the third pivot shaft and the fifth pivot shaft are coaxial, and the fourth pivot shaft and the sixth pivot shaft are coaxial.

4. The hammock according to claim 3, wherein when the hammock body frame is in the unfolded state, a limiting portion of the rear connector prevents the first rear support rod and the second rear support rod from being unfolded relatively, and a limiting portion of the front connector prevents the first front support rod and the second front support rod from being unfolded relatively.

5. The hammock according to claim 4, wherein the hammock body frame comprises a first middle connector and a second middle connector; the front end of the first rear support rod and the rear end of the first front support rod are pivotally connected to the first middle connector through the first pivot shaft; the front end of the second rear support rod and the rear end of the second front support rod are pivotally connected to the second middle connector through the second pivot shaft; and when the hammock body frame is in the unfolded state, the half-folded state or the unfolded-to-half-folded state, a limiting portion of the first middle connector prevents the first rear support rod and the first front support rod from being unfolded relatively, and a limiting portion of the second middle connector prevents the second rear support rod and the second front support rod from being unfolded relatively.

6. The hammock according to claim 5, wherein the hammock support comprises two standing posts; two hanging assemblies are respectively located on two sides of the hammock body frame and respectively correspond to the two standing posts; the two hanging assemblies each comprise hanging straps and a first connector; the first connector is connected between two ends of the hanging straps; the first connector is connected to an upper end of a corresponding standing post; and two ends of the hanging straps are connected to the hammock body frame or the fabric.

7. The hammock according to claim 6, wherein the hammock support further comprises a transverse connection assembly; and the two standing posts are connected through the transverse connection assembly and are spaced apart.

8. The hammock according to claim 7, wherein the hammock further comprises a pull strap made of a flexible material; and a front end of the pull strap is connected to a front end of the fabric or a front end of the hammock body frame, and a rear end of the pull strap is connected to the transverse connection assembly.

9. The hammock according to claim 8, wherein the fabric comprises a central area and a peripheral area; the peripheral area surrounds the central area and bulges with respect to the central area; the central area comprises united pieces made of a flexible material; adjacent united pieces are spliced together; and an edge of each of the united pieces at a splicing joint has a length greater than a straight-line distance between two ends of the edge.

10. The hammock according to claim 5, wherein the hammock support comprises four standing posts; two pairs of hanging assemblies are respectively located on two sides of the hammock body frame and respectively correspond to the four standing posts; the two pairs of hanging assemblies each comprise a hanging strap and a first connector; the first connector is connected to a first end of the hanging strap, and the first connector is connected to an upper end of a corresponding standing post; and a second end of the hanging strap is connected to the hammock body frame or the fabric;

the hammock further comprises a pull strap made of a flexible material; and a front end of the pull strap is connected to a front end of the fabric or a front end of the hammock body frame, and a rear end of the pull strap is connected to a transverse connection assembly; and the fabric comprises a central area and a peripheral area; the peripheral area surrounds the central area and bulges with respect to the central area; the central area comprises united pieces made of a flexible material; adjacent united pieces are spliced together; and an edge of each of the united pieces at a splicing joint has a length greater than a straight-line distance between two ends of the edge.

11. The hammock according to claim 1, wherein the hammock body frame comprises a first rear support rod, a second rear support rod, a first front support rod and a second front support rod; a rear end of the first rear support rod is hinged to a rear end of the second rear support rod; a front end of the first front support rod is hinged to a front end of the second front support rod; a front end of the first rear support rod and a rear end of the first front support rod are pivotally connected through a first pivot shaft; a front end of the second rear support rod and a rear end of the second front support rod are pivotally connected through a second pivot shaft; and when the hammock body frame is in the half-folded state, the fully folded state or a half-folded-to-fully-folded state, the first pivot shaft and the second pivot shaft are coaxial.

12. The hammock according to claim 11, wherein the hammock body frame further comprises a rear connector and a front connector; the rear end of the first rear support rod and the rear end of the second rear support rod are pivotally connected to the rear connector through a third pivot shaft and a fourth pivot shaft respectively; the front end of the first front support rod and the front end of the second front support rod are pivotally connected to the front connector through a fifth pivot shaft and a sixth pivot shaft respectively; and when the hammock body frame is in the unfolded state, the half-folded state or an unfolded-to-half-folded state, the third pivot shaft and the fifth pivot shaft are coaxial, and the fourth pivot shaft and the sixth pivot shaft are coaxial.

13. The hammock according to claim 12, wherein when the hammock body frame is in the unfolded state, a limiting portion of the rear connector prevents the first rear support rod and the second rear support rod from being unfolded relatively, and a limiting portion of the front connector prevents the first front support rod and the second front support rod from being unfolded relatively.

14. The hammock according to claim 13, wherein the hammock body frame comprises a first middle connector and a second middle connector; the front end of the first rear support rod and the rear end of the first front support rod are pivotally connected to the first middle connector through the first pivot shaft; the front end of the second rear support rod and the rear end of the second front support rod are pivotally connected to the second middle connector through the second pivot shaft; and when the hammock body frame is in the unfolded state, the half-folded state or the unfolded-to-half-folded state there-between, a limiting portion of the first middle connector prevents the first rear support rod and the first front support rod from being unfolded relatively, and a limiting portion of the second middle connector prevents the second rear support rod and the second front support rod from being unfolded relatively.

15. The hammock according to claim 14, wherein the hanging assemblies each comprise a hanging strap and a first connector; a first end of the hanging strap is connected to the hammock body, and a second end of the hanging strap is connected to the first connector; first connectors on the left side of the hammock body are respectively connected to upper ends of the two first intersecting posts; and first connectors on the right side of the hammock body are respectively connected to upper ends of the two second intersecting posts.

16. The hammock according to claim 15, wherein the second supporting mechanisms each comprise a third intersecting post and a fourth intersecting post, the third intersecting post and the fourth intersecting post are interesting and hinged at an intersection;

upper ends of two third intersecting posts are respectively hinged to two sixth connectors; the two sixth connectors are respectively hinged to the first intersecting post and the second intersecting post on a front side; lower ends of the two third intersecting posts are respectively hinged to two first supporting bases; and a lower end of the first intersecting post and a lower end of the second intersecting post on a rear side are respectively hinged to the two first supporting bases; and upper ends of two fourth intersecting posts are respectively hinged to two fifth connectors; the two fifth connectors are respectively hinged to the first intersecting post and the second intersecting post on the rear side; lower ends of the two fourth intersecting posts are respectively hinged to two second supporting bases; and a lower end of the first intersecting post and a lower end of the second intersecting post on the front side are respectively hinged to the two second supporting bases.

17. The hammock according to claim 16, wherein the fabric comprises a central area and a peripheral area; the peripheral area surrounds the central area and bulges with respect to the central area; the central area comprises united pieces made of a flexible material; adjacent united pieces are spliced together; and an edge of each of the united pieces at a splicing joint has a length greater than a straight-line distance between two ends of the edge.

* * * * *